United States Patent [19]

Redman

[11] 4,190,769

[45] Feb. 26, 1980

[54] THERMAL IMAGE CAMERA WITH STORAGE

[75] Inventor: Charles M. Redman, Las Cruces, N. Mex.

[73] Assignee: The United States of America as represented by the Secretary of the Army, Washington, D.C.

[21] Appl. No.: 913,412

[22] Filed: Jun. 7, 1978

[51] Int. Cl.[2] ..... H01J 31/49

[52] U.S. Cl. ..... 250/332; 250/330

[58] Field of Search ..... 250/316, 318, 330, 332, 250/333, 334, 338; 315/10

[56] References Cited

U.S. PATENT DOCUMENTS

| | | | |
|---|---|---|---|
| 1,936,514 | 11/1933 | Lengnick | 250/332 |
| 2,120,765 | 6/1938 | Orvin | 250/332 |
| 3,502,875 | 3/1970 | Ploss et al. | 250/332 |
| 4,032,783 | 6/1977 | Koda | 250/333 |

*Primary Examiner*—Bruce C. Anderson

*Attorney, Agent, or Firm*—Nathan Edelberg; Robert P. Gibson; Saul Elbaum

[57] ABSTRACT

A thermal image camera (TIC) is disclosed which is sensitive to images having wavelengths ranging substantially from the optical range to over 100 microns. Such images are hereinafter referenced as thermal images. The device further develops electron images by detection of more than 280,000 points in a plane. The subject system amplifies, integrates and stores image electrons on an insulator or dielectric grid, and gates the electron images foward on command onto a phosphor screen for direct viewing or onto electron sensitive photographic film or electrostatic recording paper for recording. The TIC is thus a three dimensional electronic data processing system having the capability of converting thermal images to electron images and further of recording images on photographic film or electrostatic paper. Means are provided for electronically storing one or more positive or negative images on an insulator grid with image intensity gain in the negative storage mode. Means are also provided for controlling the flow of electrons from a cathode to an anode by the image stored on the insulator grid.

14 Claims, 6 Drawing Figures

THERMAL IMAGE CAMERA WITH STORAGE

RIGHTS OF THE GOVERNMENT

The invention described herein may be manufactured, used, and licensed by or for the United States Government for governmental purposes without the payment to me of any royalty thereon.

BACKGROUND OF THE INVENTION

1. Field of the Invention

The present invention is related to apparatus for viewing or recording of narrow frequency band images at selectable center frequencies over the broad frequency band from optical through the far infrared or thermal frequencies, and more particularly to apparatus for the described purpose incorporating therein storage means and utilizing composite cathodes.

2. Description of the Prior Art

Ordinarily, expensive (multimillion dollar) optical camera systems are utilized for recording the best quality optical images on film of aircraft, missiles, and the like, at extended ranges. Such equipment and procedures are typically used for purposes of measuring attitude and obtaining detailed information concerning events or characteristics of the objects. In spite of the very good relative quality of the images, they often are not good enough for the extraction of needed data, however. Inasmuch as photographic film does not directly respond to longer wavelengths and to their lower photon energy, such optical systems cannot be used for infrared or thermal imaging.

Photographic film is typically capable of image resolution in excess of 500 line pair per mm. For illustrative purposes, a large telescope may ordinarily furnish images having resolutions in the range of 80 line pair per mm. Accordingly, 35 mm. film, a typical film for optical systems, furnishes approximately 2,800 line pair resolution at 80 line pair per mm. As a contrast, a typical television system can furnish 262 line pair resolution.

Thermal Imaging Systems typically use scanning techniques. That is, the system optically scans a solid angle of space and develops the final image sequentially, or point by point. Some thermal scanning systems are available with resolution characteristics which approach the characteristics of television systems, but at costs of 50 to 100 times that of television. Sequential scanning systems incorporate substantial deficiencies, however, inherent in their sequential nature. One such deficiency is the ability to view only one point, or a relatively small number of points, in the field of view at any one time. Thus, an event occurring between scans is neither detected nor imaged. For example, a scanner of good TV quality resolves approximately 272,000 picture elements. Where such a scanner views but one element at a time, it will miss what happened at the other 271,999 elements. This is a serious problem where dynamic objects are of interest, or where the objects or events of interest are either relatively small in size or short in duration. For example, an object which is one meter or less in size, at 16 KM distance, in a 36 mr field of view would always appear to be at least one to two meters in size, if detected at all. Moreover, if the duration of the activity of interest is less than a full frame scan time, it may not be detected at all. Thus, if the above example utilizes a scanner having an imaging rate of 30 frames per second, the dwell time on each picture element or picel is $1/30 \div 272{,}000$, or $1.225 \times 10^{-7}$ second. Such a dwell time is very short, leading to requirements for a highly sensitive and very low noise detector and a high gain amplifier. If better optical quality is desired, as is available from 35 mm. film for example, the problem is compounded by a factor of $(2{,}800/262)^2$ or 114, the square of the ratio of the line pair resolutions. For this level of optical quality, the dwell time becomes only 1.07 nanosecond per picel.

This problem can be lessened by adding more detection-amplifier channels. The approach of using multiple point scanners, or multiple detection amplifier channels, provides more picture elements per unit time, but simultaneously complicates and increases the cost of what is already a complex and expensive system.

Another attempt at thermal imaging is the pyroelectric vidicon, which offers the use of full frame dwell time. However, in the pyroelectric vidicon the thermal image quickly spreads through the pyroelectric and backing material by heat flow, and image detail is lost. Thus far the vidicon, while typically less expensive than the scanner, has not obtained images of scanner quality.

In the television imaging art, charge coupled devices (CCD) are being used to replace vidicons under some circumstances. New CCD systems are being developed for use with thermal wavelengths, but considerably more progress is needed to make them practical. Such devices may produce images having "TV" quality, which is inadequate for dynamic target imaging in many cases. A substantial state-of-the-art increase is needed if good thermal imaging of dynamic targets is to be accomplished.

There are urgent requirements for thermal imaging systems which can operate at 100 frames per second, obtain optical quality comparable to that available from 35 mm. film (more than $3.14 \times 10^7$ picels), and good contrast (greater than 1,000 to 1). The thermal imaging systems now in development offer little hope for ever meeting this type of performance.

Several problems of the prior art must be overcome in order to provide a good thermal imager:

1. The thermal image must be sensed and processed as an image, rather than as one or several picels at a time.
2. The image must be sensed and transferred into electronic storage in time sufficiently short to insure very little image smear. Times less than 100 microseconds are typically desirable.
3. Many very short time-sampled images must be integrated in electronic storage so as to enhance the image to noise ratio.
4. Very narrow band thermal spectra are typically required and the desired spectrum should be quickly and easily selectable.
5. Recording on continuously moving film, as opposed to the standard process utilizing stop action pin registration for framing, is highly desirable.

OBJECTS AND SUMMARY OF THE INVENTION

The present invention overcomes the deficiencies of the prior art and provides an apparatus furnishing images of the desired characteristics.

A primary object of the present invention is to overcome the shortcomings and deficiencies of the prior art and to provide a thermal imaging apparatus capable of furnishing images having the desired characteristics.

Another object of the invention is to provide a thermal image camera utilizing a composite cathode in combination with a storage mesh.

Yet another object of the invention is to photograph or record high quality images centered at wavelengths from one micron to longer than 20 microns.

Still another object of the invention is to detect thermal images and transfer them into electronic storage means for purposes of holding, integrating (with later detected images) by summing or differencing, and viewing and/or recording of the images on permanent records, such as paper or film.

Another object of the invention is to obtain very narrow band images at center frequencies that can be quickly changed over a very broad band (one micron to over 20 microns) of wavelengths.

The present invention accordingly converts a heterodyne of an image in the desired range of wavelengths (one micron to over 20 microns) with a coherent thermal signal to obtain an electronic image by means of a composite cathode. The invention apparatus transfers this electronic image via electron optics to a storage grid, either as a positive or a negative image. The system amplifies the negative images by factors of less than unity to factors well above unity, utilizing electronic control. The system further adds, subtracts, or multiplies images by means of an image storage and transfer plate with an insulator grid input. The invention additionally provides an optical view of thermal images, as well as providing permanent records of such images, on paper or film, for example.

Other objects, features, and advantages of the present invention will become more readily apparent from the following specification and appended claims, when read in conjunction with the attached drawings.

DETAILED DESCRIPTION OF THE PREFERRED EMBODIMENT

The present invention utilizes melt-grown oxide-metal composites, hereinafter referred to as composites, as developed by the Georgia Institute of Technology as a basis for a solution of the problems of the prior art. Such composites are disclosed, for example, in the Annual Technical Report of the School of Ceramic Engineering, Georgia Institute of Technology, on Melt-Grown Oxide-Metal Composites, July, 1972, sponsored by Advanced Research Projects Agency, Department of Defense, ARPA order No. 1637, hereinafter Reference 1. Inasmuch as detailed information is available in the report, the composites are described only briefly herein. Such composites comprise approximately $10^7$ parallel metal fibers in each square centimeter of an oxide matrix. One form of composites utilizes tungsten fibers in a uranium dioxide matrix, but other forms are similarly useful.

Figure 1:
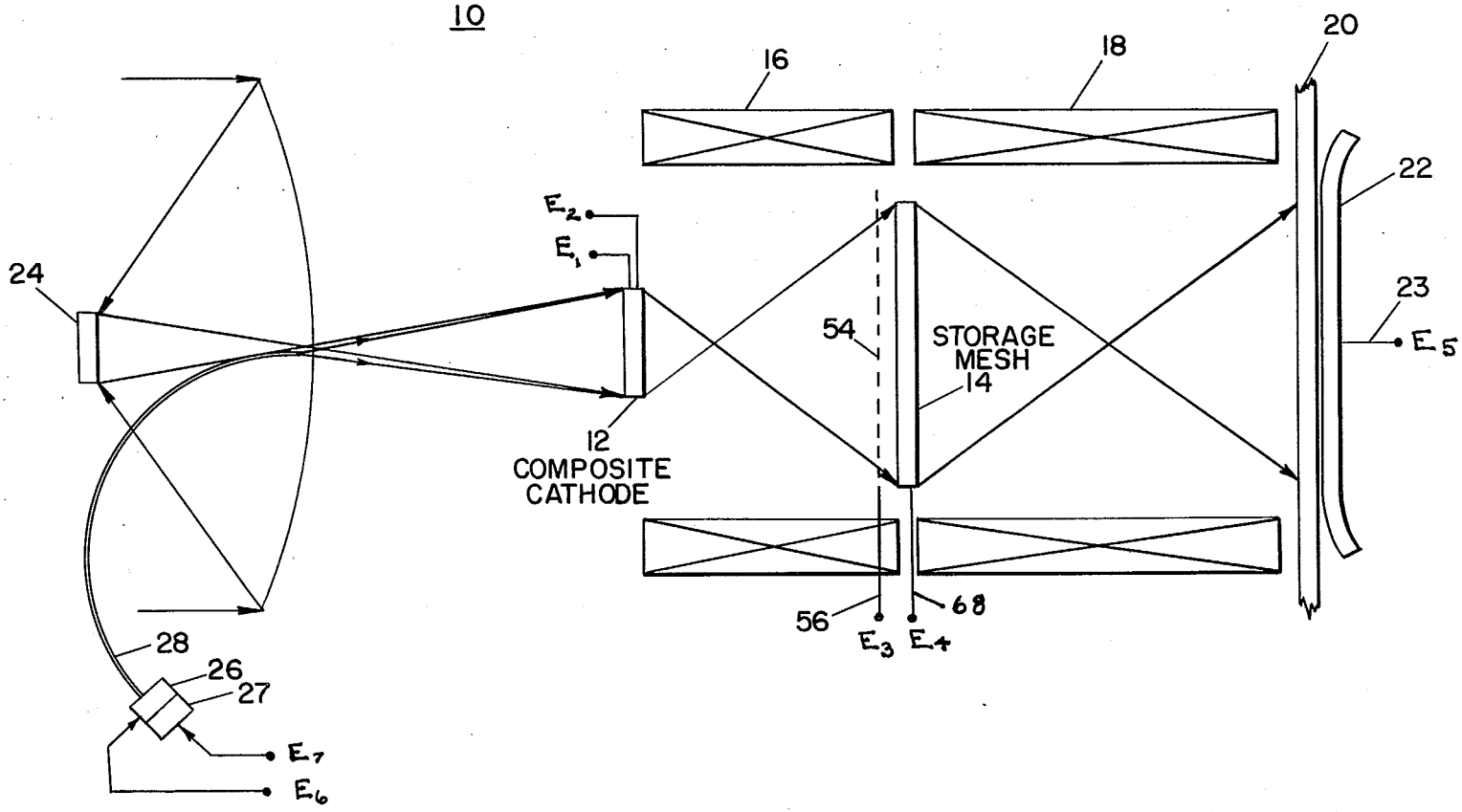
FIG. 1 is a general schematic view of the thermal image camera.

In the present invention, shown in FIG. 1, a thermal image camera 10 is shown utilizing therein a composite cathode 12 and a storage mesh 14. The use of a composite cathode is disclosed in my prior U.S. Pat. No. 4,031,393, incorporated herein by reference, and essentially replaces a scanning electron gun by a cathodic surface, emitting electrons responsive to an impinging image. A focusing means 16 is provided for focusing the electrons emitted by cathode 12 on storage mesh 14. The preferred embodiment utilizes magnetic focusing, as shown on the figure wherein reference numeral 16 refers to magnetic focusing coils. However, other focusing techniques may be used. As is known to those skilled in the art, the image stored in mesh 14 may be viewed by flooding the mesh with electrons from cathode 12, and focusing the electrons passing through the mesh by focusing means 18, again illustratively shown as magnetic focusing means, upon a viewing surface 20. The preferred embodiment utilizes a recording film as the viewing surface, and provides a permanent record of the image in conjunction with backplate 22.

An image is initially focused on cathode 12 by thermal optics 24. The image is heterodyned with the output radiation of laser 26, which may be placed away from the image path and provided with a fiber optic waveguide 28 to provide the reference image to cathode 12.

The diode laser 26 is a lead-salt type as described in "Tunable Laser Diode Review," published in *Electro-Optical Systems Design,* April, 1976. This diode is advantageously tunable through the thermal spectrum, and may, for example, be tuned to 10 micrometers. As shown in the Figure, a Peltier Cooler 27 may be used in conjunction with laser 26. The output of the laser diode is guided so as to illuminate the front face of the composite cathode 12. Radiation through the optical system also illuminates front face 30 of the composite, where it heterodynes with the 10 micrometer radiation. The heterodyning of electromagnetic waves in the infrared or thermal region of the spectrum is accomplished by making use of the square law properties of the pyroelectric detector film in the proximity of a metal filament. The electronic circuits of the composite cathode efficiently respond to a narrow band of difference or heterodyned frequencies. The circuits also respond to warming and cooling caused by radiation on the front face of the composite cathode or by other causes, such as convection, for example. However, the apparatus is typically more sensitive to heterodyne effects than to heating effects by a factor exceeding $10^6$.

Figure 4:
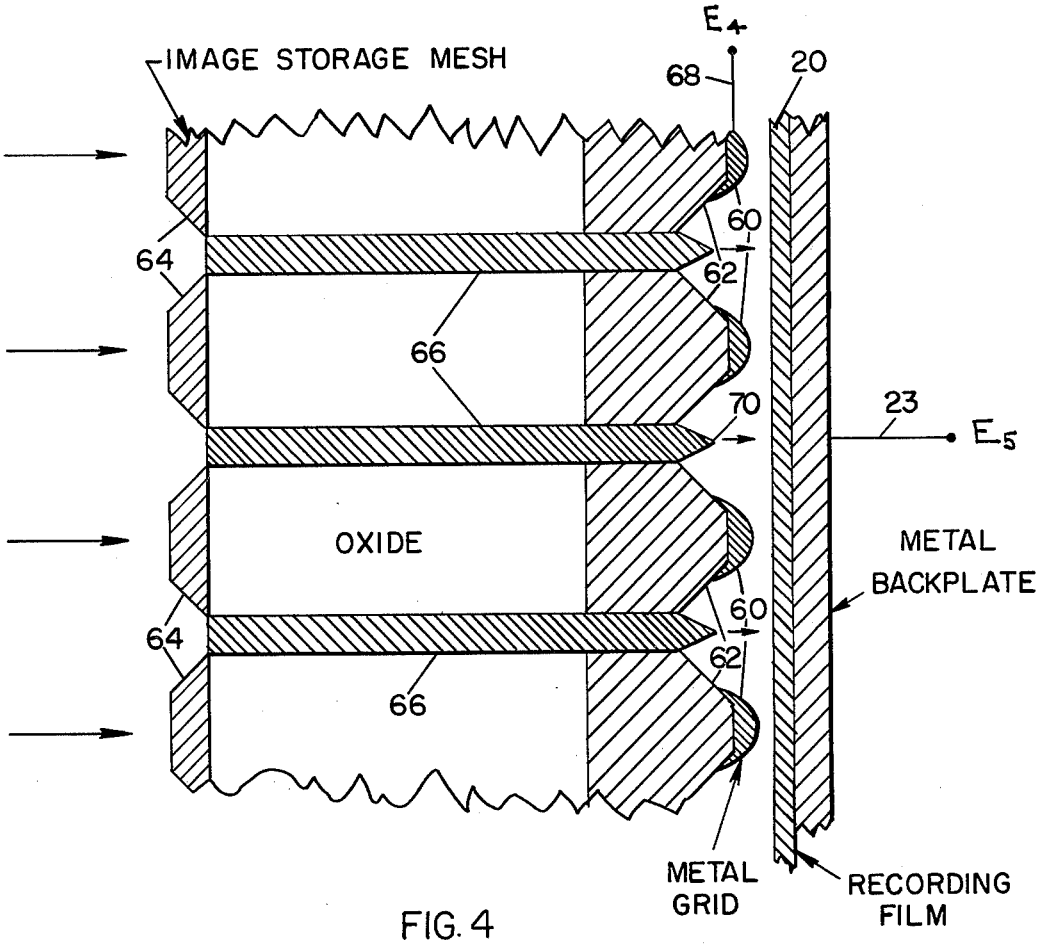
FIG. 4 shows three elements of the image storage and transfer plate.

The imaging electrons generated by the cathode are available for image generation and viewing. Such electrons may be used to store an image on a storage mesh, or may be focused directly upon a viewing and/or recording means 20. That is, while the image storage and transfer plate, shown in FIG. 4, is used in and greatly improves the performance of the embodiment of FIG. 1, it is not essential for the operation of the TIC.

Figure 2:
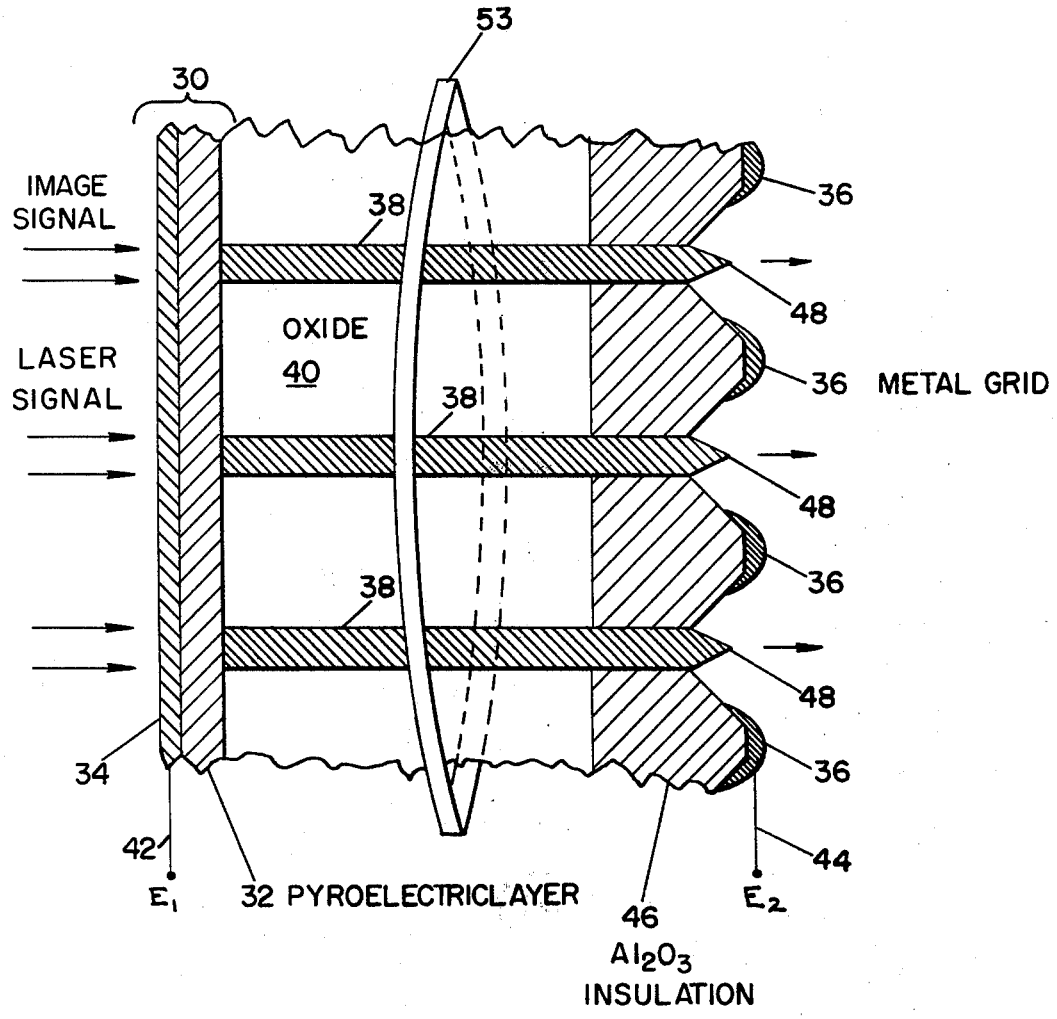
FIG. 2 is a cross section of a small part of the composite cathode of FIG. 1.

Referring now to FIG. 2, a small section of a composite cathode is shown.

The thermal image of interest is focused onto the front face 30 of the composite cathode 12, where it is converted to free electrons in pyroelectric layer 32. The electron image is then cycled out of the cathode through electronic control of the front face conducting film 34, the output or backface metal film grid 36, and potential applied to the storage mesh. The individual metal filaments 38 of the composite cathode are embedded in oxide matrix 40. A lead 42 is connected to conducting film 34 for applying control potential $E_1$ thereto. Lead 44 is similarly connected to metal grid 36 for applying potential $E_2$.

Figure 3B:
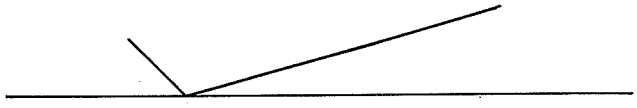
FIGS. 3*b* and 3*c* show the potential distribution for the elements of the composite cathode shown in FIG. 3*a*.
Figure 3A:
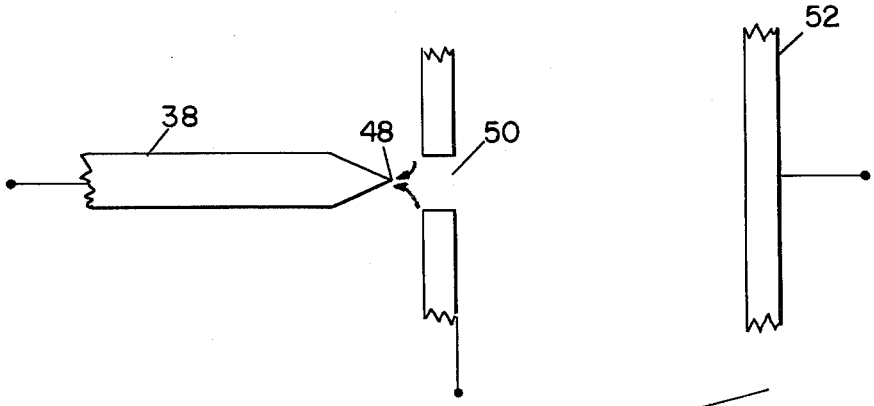
FIG. 3*a* shows one element of the composite cathode in greater detail.
Figure 3C:
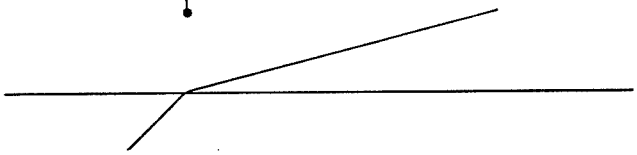

The operation of a single filament circuit is illustrated by reference to FIG. 3, which shows a point 48 of one of the conducting filaments 38, a coaxially aligned grid hole 50, and an anode 52 which is the storage mesh 14 of FIG. 1. The pyroelectric picel and the front face conducting film are not shown in this figure. FIG. 3*a* shows electrons being cycled from the grid to the point 48. More potential is required to cause grid to point flow than is required for point to grid flow, which is a disadvantage. FIGS. 3*b* and 3*c* show the potential distribution for the element of FIG. 3*a* biasing the element for point to grid and grid to point flow.

Another, superior technique for performing this function of cycling electrons back to the point exists, however. Some oxides such as uranium dioxide ($UO_2$) are semiconductors. $UO_2$ has a resistance of about 1,000 ohms per square, a very high figure when compared to tungsten, but very low when compared to $Al_2O_3$. One of the easiest to produce, and highest quality composites, is tungsten in $UO_2$. A composite cathode as shown in FIG. 2 can best be made from $UO_2$. A thin metal band 53 can be deposited around the composite cathode so as to make good electrical connection to the oxide, but not to the metal grid, the input conducting film, or the pyroelectric film. When suitably biased, electrons flow from the metal band, and through the $UO_2$, to discharge the elemental capacitances. By holding the metal band and the input conducting film at a common potential, $E_1$, and the metal grid at a more positive potential, $E_2$, image electrons flow predominantly through the low impedance metal filaments to the filament points, rather than through the $UO_2$ to the metal band. The image electrons then build up on the points, or are emitted into vacuum toward an anode of more positive potential.

The electronic cycling of the composite cathode is done in a manner so as to minimize the effects of variations in the characteristics of the many metal filament points. Image nutation is another technique for minimizing the effects of these variations. This is done by synchronously nutating the thermal image on the composite cathode, and the electron image on the image storage and transfer plate. Thus, a particular image picel is detected and an electron field corresponding thereto is emitted from different metal filaments, but ends up in the same element of the image storage and transfer plate. An average detection sensitivity of all the metal filaments through which the picel is transferred is thereby obtained.

In operation, the heterodyned image provides thermal signals detected by pyroelectric layer 32. The detected signals are directly coupled to the metal filament point which serves as an electron field emission cathode. Upon placing the grid potential $E_2$ below the point potential, the point emission is cut off. Increasing the grid potential $E_2$ just to the electron emission point allows the signal electrons to flow during negative portions of the signal cycles and permits reduced, or reversed, or null electron flow during the positive portion of the signal cycles. Electrons emitted from the points 48 first move toward the grid 36, but if the anode 52 behind the grid is at a still higher positive potential, the electrons will pass the grid to reach the anode. Reverse flow electrons emit from the grid toward the points. Since the voltage gradiant from the grid 36 to the points 48 is steeper than that to the anode 52, the electrons continue to the points. During signal transfer through the composite cathode circuits, electrons leaving the points proceed to the anode and electrons are then replaced via grid-to-point flow or by means of the flow through the oxide. This causes each circuit to be a heterodyning and detecting circuit. The pyroelectric film 32 is a dielectric, thus making the combination of filament 38—pyroelectric 32 input conducting film 34 a capacitor. Emission of electrons from the points develops a charge across the elemental capacitors 38-32-34, causing the grid-to-point potential to decrease, and electron field emission to cut off. This makes it necessary to cycle the grid with respect to the front face conducting film 34 at some optimum rate. Such cycling causes reverse electron flow to replace electrons emitted from the points. Typically, reverse flow recharges the pyroelectric elemental capacitors with electrons. With the anode voltage held low, the grid is made positive with respect to the point so that forward flow electrons go to the grid. Current flows until the point-to-grid potential is just below the point of electron field emission. Sufficient elevation of the anode potential then again causes signal electrons to go to the anode. The cycling action hereinabove described is also termed subframing. Subframe images are moved to the image storage mesh, or to the image storage and transfer plate of FIG. 4. For example, subframing might operate at 10 KHz and full framing at 100 Hz. Such operation accordingly provides 100 subframes per each full frame.

An image storage mesh is described in some detail in "Image Processing with Storage Image Tubes," Technical Note 103, published by Electro-Optical Products Division of ITT, Tube and Sensor Labs, Fort Wayne, Indiana. There are several different techniques for amplifying and storing images and the mesh used in this image tube is one which has been in use. If the mesh potential with respect to the composite cathode is relatively low, the image electrons from the composite cathode collect on the mesh insulation. Gains up to unity with a positive image can be realized. If higher mesh potential is used, the image electrons strike the mesh with sufficient force to cause the release of many secondary emission electrons. By placing a secondary electron collecting mesh 54, connected by lead 56 to biasing potential $E_3$, just ahead of the storage mesh, these secondary electrons can be collected and drained away. Such drainage of the secondary electrons leaves a positive charge on the storage mesh 14 (a negative image). Significant gain may be realized in this way. Magnetic or electrostatic focusing can be used to focus the electron image released from the composite cathode onto the storage mesh. Many subframes (100 in the previous example) can be integrated and stored on the storage mesh.

A phosphor viewing plate can be placed behind the storage mesh. After storage of a desirable number of subframes on the storage mesh, the image is converted to an optical image at the phosphor viewing plate by suitably biasing each stage and pulsing the composite cathode grid on electrodes 56, 68 and 23. The grid pulse causes a large number of flooding electrons to be released from the composite cathode points. The storage mesh potential $E_4$ accelerates the released electrons from the composite. By making the phosphor viewing plate biasing potential $E_5$ more positive than the mesh, at least some of the electrons pass through the mesh and impact in the phosphor causing the grains thereof to radiate. While a phosphor plate has been described, clearly any suitable electro-optic conversion means may be used. The extent to which electrons pass through each hole in the grid depends on the image charge at that hole. The more positively is the mesh charged at the hole, the more electrons will pass therethrough. The more negatively charged, the fewer electrons. If the mesh is sufficiently negatively charged at the hole, no electrons will pass. The image stored on the mesh thus controls the pulsed electron cloud from the composite cathode, so that the cloud carries the mesh information when it impacts on the viewing plate.

The electron cloud does not destroy the image on the storage mesh, so that the phosphor image can be repeated many times. The image on the storage mesh 14 may be erased by suitably biasing the mesh while flooding it with electrons from the composite cathode. These techniques are described in the above-referenced Technical Note.

The viewing plate image can be optically transferred to film. By use of suitably short transfer pulses at the grid 36 of the composite cathode, and by using a phosphor plate with a very short radiation period, the images can be transferred to film in such a short period that the film can move continuously instead of discretely, as in the standard stop action type of film transport.

The phosphor viewing plate can be replaced by the film itself with a metal back plate 22 behind it. The image electrons are accelerated by the electronic focusing means toward the back plate, but impact in the film, thus exposing it. This technique would ordinarily require that the film be transferred through a vacuum.

The melt-grown oxide-metal composites allow direct electron exposure of film without the encumbrance of operating the film in a vacuum. FIG. 4 shows a sketch of a device which replaces the image storage mesh. The image storage and transfer plate (ISTP) is like the composite cathode on the backside with insulating grid 62 and conducting grid 60, but the pyroelectric and conducting films on the front side are replaced by an insulating grid 64. The image storage function of the ISTP is similar to that of the storage mesh previously described. However, instead of holes for the forward transfer of the image electrons, the ISTP uses metal filaments 66. During image transfer, the ISTP output metal grid 60 is biased to a potential $E_4$ by means of lead 68 so that image electrons passing the image stored on the insulator and entering the metal filaments are field emitted on the output side at point 70, and impact in the film, thus exposing it. The ISTP is solid and can thus be used as a vacuum seal. The ISTP insulating mesh 64 is in the vacuum to integrate and store electron images, and the output side including grids 60 and 62 and points 70 is exposed to the air. The ISTP has a finer mesh than the storage meshes now used in storage image tubes. The ISTP can therefore be the same diameter as the composite cathode, and recording can be done on 8 mm film instead of 16 mm. This film appears to be very narrow for quality image recording, but in the example provided the primary goal is to surpass TV image recording, and film can record more line pairs per mm than a TV camera can process, as previously explained. The gap between the ISTP output metal filament points 70 and the recording film 20 is small because of the effect of air molecules on the image electrons, but must be great enough to insure that the photographic film does not touch the output metal grid 60.

The method of growing the composite, not part of the invention, utilizes a mix of ceramic and metal in a resistance-induction furnace. Resistance heating brings a sample of mix close to its melting point. Induction heating melts a zone in the mix but does not melt through the outside of the mix. The output zone of the mix acts as the crucible to hold the melt. The metal particles drift to small zones of the metal. The melt zone is moved up through the mix and the metal zones form into wires or fibers 38. The composite is then cut to length and the outer zone cut away. State-of-the-art technology has demonstrated that good 18 mm diameter devices and 6 mm devices with grid structures are apparently quite reasonable. Larger gridded devices pose no serious problem and are similarly feasible to at least 16 mm. Clearly, as technological advances are made, larger devices will be produced. Size is not a limiting factor in the present invention. "High Stability Long Life Field Emission Electron Source with High Brightness," as reported by the school of Electrical Engineering, Georgia Institute or Technology, under subcontract for prime contract FO 8606 C-002, reviews some of the work on gridded devices in the report covering the period Sept. 1, 1974 through Dec. 1, 1974, hereinafter Reference 2.

The composite cathode construction starts with a properly prepared wafer of composite. A technology demonstration wafer is about 6 mm in diameter and 3 mm thick, and has about 3.1 million picture resolving elements and 1.1 million image wavelength resolving elements or picels at 10 mm wavelength. This cathode thus resolves four times as many picels as does a good television camera and about one-third of those obtained with a typical film camera system. This size wafer is, therefore, a good demonstration size but a larger cathode should be used for enhanced resolution. Preparation of the wafer, not forming part of the present invention, is described below.

The composite wafer is first prepared with two polished and parallel surfaces. The oxide on one surface is etched back from the filaments about 10 mm and the filaments 38 etched to points 48 as shown in FIG. 52, page 95, of Reference 1. Aluminum oxide ($Al_2O_3$) or similar good insulating material 46 is deposited around the metal filaments and on the oxide to a depth exceeding 10 $\mu$m. Ion milling or differential etching is then used to cut cones in the $Al_2O_3$ to expose the filaments 58 but destroy as little of the filament points 48 as possible. A metal film such as aluminum is then deposited as shown in Reference 2 or by other thin film deposition techniques. Any metal films which may have been required during construction on the front face 30 of the composite (opposite to the ion milled face) are then removed. A thermally sensitive thin layer such as pyroelectric 32 is then deposited on the front face 30 so as to make good electrical contact with the metal filaments 38. An electrical conducting film 34 is then deposited over the pyroelectric film. This film must be transparent to the thermal radiation to allow heterodyning of the laser radiation and the thermal image signals in the pyroelectric. The pyroelectric film should be a highly sensitive material, such as triglycene sulphate (TGS), for example. However, less sensitive films, such as polyvinyl fluoride and nylon 11, may be easier to deposit. While TGS is about 40 times as thermally sensitive as polyvinyl fluoride, the TIC can have high amplification, and it is the thermal noise in the film which is the limiting factor. Heterodyne detection sensitivities to $10^{-17}$ watts per square root of Hz have been reported (see, for example, "The Experimental Results of Beating Spontaneously Emitted and Laser Light," D. Warner, Jr., The Johns Hopkins University, Baltimore, Maryland, reporting on contract F33615-69-C-1317, Project 4036, Task 403601, administered by the Air Force Avionics Laboratory, Wright-Patterson Air Force Base, Ohio). Polyvinyl fluoride is about as sensitive to heterodyne detection as is TGS and may accordingly be used.

I wish it to be understood that I do not desire to be limited to the exact details of construction shown and described, for obvious modifications can be made by a person skilled in the art.

I claim:

1. In a thermal image camera comprising an area detecting cathode having a front and a back face, means for focusing thermal images on said front face, means for generating and guiding a coherent thermal signal to illuminate said front face, means for generating an electron image at said back face, and means for focusing said electron image, the improvement comprising:

(a) means within said area cathode for converting the different frequencies between the thermal image and the coherent thermal signal to said back face electron image, (b) storage means in said camera receiving and storing said electron from said back face, (c) first focusing means for focusing said electron image on said storage means, (d) means for transferring said electron image from said back face to said storage means, (e) viewing means for said electron image, (f) second focusing means for said electron image emitted by said storage means onto said viewing means.

2. Thermal image camera as recited in claim 1 wherein said viewing means further comprises permanent image recording means, and wherein said camera comprises control means forming said electron image on said viewing means for a short duration of time, thereby permitting continuous, high speed motion of said recording means.

3. A thermal image camera as recited in claim 1 wherein said means for transferring said electron image to said storage means further comprises means for transferring said image to said viewing means, having means for establishing a potential gradient at said storage means, including a plurality of metallic conductors and a metallic grid adjacent thereto, and wherein said viewing means is disposed in free air.

4. A thermal image camera as recited in claim 1 wherein said storage means comprises front and back sides, said front side comprising an insulating storage mesh, said back side comprising an insulating mesh and a conducting mesh adjacent thereto, said storage means further comprising conductive fibers disposed between said insulating meshes on said front and back sides.

5. A thermal image camera as recited in claim 4 wherein said conducting fibers comprise pointed terminals disposed at said back side of said storage means.

6. A thermal image camera as recited in claim 1 wherein said means for generating and guiding comprises laser means tuned to a particular frequency, said difference frequencies occurring in a narrow frequency band centered at said particular frequency, said means within said cathode comprising means for detecting said narrow frequency band.

7. A thermal image camera as recited in claim 6 wherein said laser means comprises tunable laser means, tunable to frequencies ranging from optical to thermal frequencies.

8. A thermal image camera as recited in claim 1 further comprising manipulating means for images stored on said storage means, said manipulating means comprising means for integrating said stored image with subsequently stored images.

9. A thermal image camera as recited in claim 8 wherein said integrating means further comprises summing and differencing means for images stored on said storage means.

10. A thermal image camera as recited in claim 1 further comprising means for synchronously nutating said thermal image and said electron image.

11. A thermal image camera as recited in claim 1 wherein said means for guiding a coherent thermal signal comprises fiber optic means.

12. A thermal image camera as recited in claim 1 further comprising means for discharging said area cathode, said discharging means comprising a metallic band contacting an oxide substrate of said area cathode.

13. A thermal image camera as recited in claim 1 further comprising secondary electron collecting mesh means disposed adjacent said storage means and on the area cathode side thereof.

14. A thermal image camera as recited in claim 1 wherein said area detecting cathode comprises:

(a) pyroelectric means at said front face thereof, (b) an insulating mesh and a conductive mesh at said back face thereof, and (c) conductive fiber means disposed between said pyroelectric means and said insulating mesh.

* * * * *